US007987891B2

(12) United States Patent
Zhou

(10) Patent No.: US 7,987,891 B2
(45) Date of Patent: Aug. 2, 2011

(54) TRIPLE LAYER FOLDING DOOR

(75) Inventor: Zhaohong Zhou, Shanghai (CN)

(73) Assignee: Bathman Shanghai Bathroom Equipment Co., Ltd., XinQiao Industrial Zone, Songjiang District, Shanghai (CN)

( * ) Notice: Subject to any disclaimer, the term of this patent is extended or adjusted under 35 U.S.C. 154(b) by 240 days.

(21) Appl. No.: 12/334,464

(22) Filed: Dec. 14, 2008

(65) Prior Publication Data

US 2009/0151261 A1 Jun. 18, 2009

(51) Int. Cl.
*E06B 3/50* (2006.01)

(52) U.S. Cl. ..... 160/185; 160/220

(58) Field of Classification Search ..... 160/185, 160/197, 202, 220, 221, 222, 223, 224; 49/116, 49/121, 123, 127
See application file for complete search history.

(56) References Cited

U.S. PATENT DOCUMENTS

| | | | | | |
|---|---|---|---|---|---|
| 1,534,210 | A * | 4/1925 | Griffith et al. | ..... | 49/102 |
| 1,838,491 | A * | 12/1931 | Martin | ..... | 49/102 |
| 1,960,860 | A * | 5/1934 | Allen | ..... | 160/188 |
| 2,373,023 | A * | 4/1945 | Goodwin | ..... | 49/102 |
| 2,425,016 | A * | 8/1947 | Weaver | ..... | 49/102 |
| 2,841,390 | A * | 7/1958 | Urquhart | ..... | 49/102 |
| 3,067,813 | A * | 12/1962 | Henatsch | ..... | 160/32 |
| 3,072,394 | A * | 1/1963 | Henatsch | ..... | 49/102 |
| 3,425,160 | A * | 2/1969 | Petterborg | ..... | 49/127 |
| 4,852,300 | A * | 8/1989 | Keast | ..... | 49/102 |
| 6,311,757 | B1 * | 11/2001 | Schuette et al. | ..... | 160/202 |

* cited by examiner

*Primary Examiner* — David Purol

(57) ABSTRACT

A triple layer folding door includes an inner layer door, an outer layer door, a middle layer door provided therebetween, and a sliding arrangement, which comprises: a left and right pulley mounted on a both end portion of the middle layer door respectively, a left belt winding on the left pulley, wherein a first end of the left belt extending to the right end portion of the inner layer door from the left pulley and a second end of the left belt extending to the right end portion of the outer layer door from the left pulley, and a right belt winding on the right pulley, wherein a first end of the right belt extending to the left end portion of the inner layer door and a second end of the right belt extending to the left end portion of the outer layer door.

4 Claims, 1 Drawing Sheet

TRIPLE LAYER FOLDING DOOR

BACKGROUND OF THE PRESENT INVENTION

1. Field of Invention

The present invention relates to a folding door, and more particularly to a sliding arrangement of a triple layer folding door.

2. Description of Related Arts

At present, the triple layer folding door is usually used for shower stall. Chinese patent CN02265533.6 discloses a triple layer folding door, mounted on a beam track respectively. A hitting block at an after-edge of the first layer of the tripe layer folding door hits the second layer of the tripe layer folding door, so as to drive the second layer to move. Likewise, the second layer hits the third layer so as to drive the third layer to move. However, in practice, a large force may be applied to pull the triple layer folding door, which will cause loud noise when the layers hit each other. Especially in a quiet night, it is very annoying to hear such unpleasant noise, and the loud noise will also affect others' sleep in the same house. So, it is desirable to provide a triple layer folding door without noise.

SUMMARY OF THE PRESENT INVENTION

An object of the present invention is to provide a triple layer folding door driven by a sliding arrangement thereof, instead of by a hitting block, so as not to generate loud noise during the sliding process.

Accordingly, in order to accomplish the above object, the present invention provides a triple layer folding door, comprising:

an inner layer door having a left end portion and a right end portion, an outer layer door having a left end portion and a right end portion, a middle layer door, having a left end portion and a right end portion, provided between the inner layer door and the outer layer door, and a sliding arrangement, which comprises:

two pulleys having a left pulley mounted on a left end portion of the middle layer door and a right pulley mounted on a right end portion of the middle layer door, two belt having a left belt winding on the left pulley, wherein a first end of the left belt extending to the right end portion of the inner layer door from the left pulley and a second end of the left belt extending to the right end portion of the outer layer door from the left pulley, and a right belt winding on the right pulley, wherein a first end of the right belt extending to the left end portion of the inner layer door from the right pulley and a second end of the right belt extending to the left end portion of the outer layer door from the right pulley.

The length of the belt is twice the length of the one layer door.

The advantage of the present invention is simple in structure and will not generate noise, so as to be suitable for all kinds of triple layer folding door, especially used for shower stall.

These and other objectives, features, and advantages of the present invention will become apparent from the following detailed description, the accompanying drawings, and the appended claims.

DETAILED DESCRIPTION OF THE PREFERRED EMBODIMENT

Figure 1:
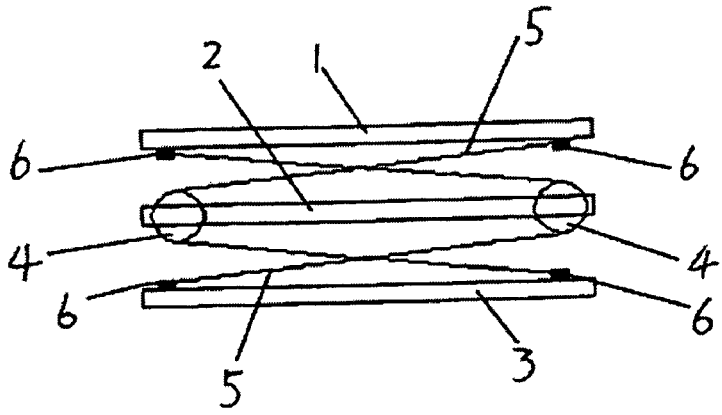
FIG. 1 is a top view of a sliding arrangement of a triple layer folding door according to a preferred embodiment of the present invention, when the three layer doors overlap.
Figure 2:
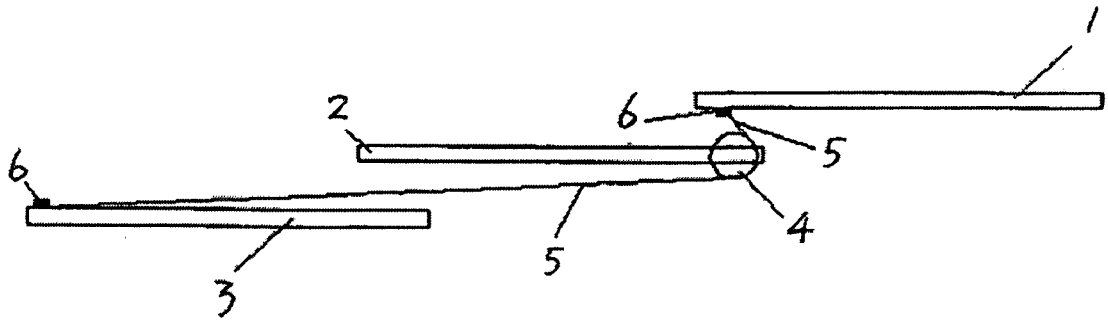
FIG. 2 is a top view of a sliding arrangement for a triple layer folding door according to the above preferred embodiment of the present invention, when the triple layer folding door is pulled to a right side.
Figure 3:
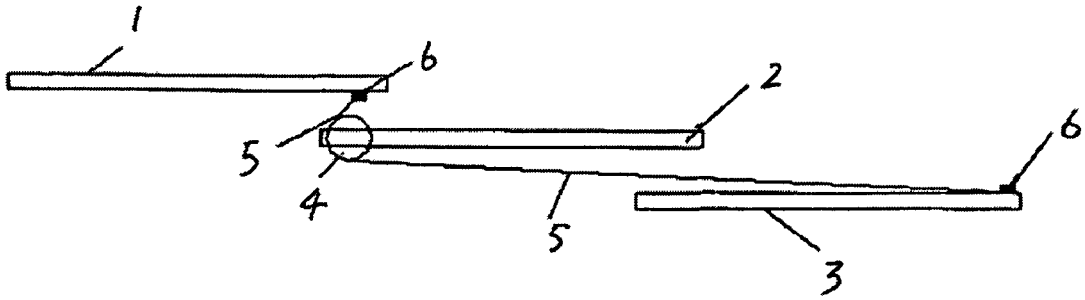
FIG. 3 is a top view of a sliding arrangement for a triple layer folding door according to the above preferred embodiment of the present invention, when the triple layer folding door is pulled to a left side.

Referring to FIG. 1, FIG. 2 and FIG. 3 of the drawings, a sliding arrangement of a triple layer folding door with three layer doors according to a preferred embodiment of the present invention is illustrated, wherein the three layer doors are hanged and folded between an upper and lower beam track (not shown in the drawings), and three layer door have same width.

A triple layer folding door comprises an inner layer door 1 having a left end portion and a right end portion, an outer layer door 3 having a left end portion and a right end portion, a middle layer door 2, having a left end portion and a right end portion, provided between the inner layer door and the outer layer door, and a sliding arrangement. The sliding arrangement comprises two pulleys 4 having a left pulley mounted on a left end portion of the middle layer door 2 and a right pulley mounted on a right end portion of the middle layer door 2, and two belt 5 having a left belt winding on the left pulley, wherein a first end of the left belt extending to the right end portion of the inner layer door 1 from the left pulley and a second end of the left belt extending to the right end portion of the outer layer door 3 from the left pulley, and a right belt winding on the right pulley, wherein a first end of the right belt extending to the left end portion of the inner layer door 1 from the right pulley and a second end of the right belt extending to the left end portion of the outer layer door 3 from the right pulley. The length of the belt 5 is twice the widths of the one layer door. The belt 5 is connected to the inner layer door and outer layer door via a fastening device 6.

The operation of the triple layer folding door is illustrated as follows. When the inner layer door 1, the middle layer door 2 and the outer layer door 3 are all in left and overlap with each other, pull either the inner layer door 1 or the outer layer door 3 towards right, then the middle layer door 2 will move towards right together driven by the belt 5. After the first moved door (the inner layer door 1 or the outer layer door 3) has moved a distance of two widths of one layer door, the inner layer door 1, the middle layer folding door 2 and the outer layer folding door 3 are totally unfolded, and arranged in parallel position, as shown in FIG. 2.

Because there are two symmetric belts 5, when the inner layer door 1, the middle layer door 2 and the outer layer door 3 are all in right and overlap with other, the operation is same with the above-mentioned process. Pull either the inner layer door 1 or the outer layer door 3 towards right, and then the middle layer folding door 2 will move towards left together driven by another belt 5. After the first moved door (the inner layer door 1 or the outer layer door 3) has moved a distance of two widths of one layer door, the inner layer door 1, the middle layer door 2 and the outer layer door 3 are totally unfolded, and arranged in parallel position, as shown in FIG. 3.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A triple layer folding door, comprising:

an inner layer door having a left end portion and a right end portion, an outer layer door having a left end portion and a right end portion, a middle layer door having a left end portion and a right end portion, provided between the inner layer door and the outer layer door, and a sliding arrangement, which comprises:

two pulleys having a left pulley mounted on a left end portion of the middle layer door and a right pulley mounted on a right end portion of the middle layer door, two belts, having a left belt winding on the left pulley, wherein a first end of the left belt extending to the right end portion of the inner layer door from the left pulley and a second end of the left belt extending to the right end portion of the outer layer door from the left pulley, and a right belt winding on the right pulley, wherein a first end of the right belt extending to the left end portion of the inner layer door from the right pulley and a second end of the right belt extending to the left end portion of the outer layer door from the right pulley;

wherein the movement of the inner door and the movement of the outer door are both able to bring the middle door move, and thereby the inner door, middle door and the outer door are all able to move together toward the right or left to be unfolded.

2. The triple layer folding door, as recited in claim 1, wherein the three layer folding door have the same width.

3. The triple layer folding door, as recited in claim 2, wherein the length of the belts is twice the widths of the any one layer door.

4. The triple layer folding door, as recited in claim 3, wherein the belt is connected to the inner layer door and outer layer door through a fastening device.

* * * * *